US006949062B2

(12) United States Patent
Theilacker

(10) Patent No.: US 6,949,062 B2
(45) Date of Patent: Sep. 27, 2005

(54) APPARATUS FOR ADJUSTING PULL ROLLERS AND/OR CUTTING KNIVES IN FOLDERS

(75) Inventor: Klaus Theilacker, Friedberg-Rederzhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/696,009

(22) Filed: Oct. 29, 2003

(65) Prior Publication Data

US 2004/0159251 A1 Aug. 19, 2004

(30) Foreign Application Priority Data

Oct. 30, 2002 (DE) ..... 102 50 433

(51) Int. Cl.[7] ..... B31B 1/28
(52) U.S. Cl. ..... 493/475; 443/478
(58) Field of Search ..... 493/475, 478, 493/479; 83/358, 359

(56) References Cited

U.S. PATENT DOCUMENTS 3,774,491 A 11/1973 Killilea
3,896,712 A * 7/1975 Ehlscheid ..... 493/30
4,036,115 A * 7/1977 Hatch ..... 493/235
5,096,175 A * 3/1992 Lange et al. ..... 270/49
5,328,437 A 7/1994 Mayländer et al.
5,790,168 A 8/1998 Sano et al.
6,358,192 B1 * 3/2002 Michalik ..... 493/424
6,398,704 B1 * 6/2002 Shibuya et al. ..... 493/424

FOREIGN PATENT DOCUMENTS

DE 668 877 12/1938
EP 0 457 304 A1 11/1991

* cited by examiner

*Primary Examiner*—Eugene Kim
(74) *Attorney, Agent, or Firm*—Cohen, Pontani, Lieberman & Pavane

(57) ABSTRACT

An apparatus for adjusting pressure rollers and/or cutting knives includes driven pull rollers or driven pull and knife rollers extending over the web width arranged opposite the pressure rollers and/or cutting knives and at least two threaded spindles, which are used to axially adjust the pressure rollers and/or the cutting knives simultaneously or immediately one after another. During the axial adjustment, some of the pressure rollers and/or the cutting knives remain stationary, some of the pressure rollers and/or cutting knives are adjusted by a first adjustment travel and/or some of the pressure rollers and/or cutting knives being adjusted by a second adjustment travel.

18 Claims, 7 Drawing Sheets

APPARATUS FOR ADJUSTING PULL ROLLERS AND/OR CUTTING KNIVES IN FOLDERS

BACKGROUND OF THE INVENTION

1. Field of the Invention

The invention relates to an apparatus for adjusting the position of pressure rollers and/or cutting knives on folding assemblies and/or turning assemblies and web guiding elements.

2. Description of the Related Art

In known printing presses which are capable of handling variable web widths, the folding assemblies adjust to different web widths by either displacing the folding formers or cutting the printing material webs into two part-webs upstream of the folding former and leading the respective part-webs to the center of the stationary folding former by turner devices such as, for example, turner bars. In both cases, the cutting knives and/or the pressure rollers, which are set against unprinted regions of the printing material webs, must be set to the new format resulting from the different width of the printing material web. For example, in the case of a double former arrangement, which is very frequently implemented in folder assemblies, there are 16 pressure rollers and up to 3 cutting knives which have to be adjusted to the different formats, in each case 8 pressure rollers on the front side and 8 pressure rollers on the rear side of the printing material web being set against the latter.

In known devices, the adjustment of the 16 pressure rollers and 3 cutting knives is performed manually or by 19 different adjusting apparatuses each having its own drive. That is to say, 19 motors are needed for the adjustment of the pressure rollers and cutting knives. This requires a high material expenditure and considerable adjustment effort.

SUMMARY OF THE INVENTION

It is an object of the invention to provide a method of adjusting pressure rollers and/or cutting knives in a folder assembly which can be implemented with a low number of drives.

The apparatus for adjusting the pressure rollers and/or cutting knives in folder assemblies, in particular in the folding former plane, comprises driven pull rollers arranged opposite the pressure rollers and/or cutting knives or driven pull rolls extending over the web width and comprises at least two threaded spindles for axially adjusting the pressure rollers and/or the cutting knives. During the axial adjustment, some of the pressure rollers and/or cutting knives remain stationary, some of the pressure rollers and/or cutting knives are adjusted by a first adjustment travel and/or some of the pressure rollers and/or cutting knives are adjusted by a second adjustment travel.

The advantage of the configuration according to the present invention is that adjustment of all the pressure rollers and/or cutting knives may be performed in one operation. That is, simultaneous adjustment of all the pressure rollers and/or cutting knives, or adjustments that can be carried out immediately one after another are possible.

For this purpose, it is necessary to arrange all the pressure rollers and/or cutting knives such that they can be displaced axially and fixed in the axial position by a threaded bush in which the respective threaded spindle can rotate. The axial position is adjusted by rotating this threaded spindle. This is feasible if the common threaded spindle, depending on the position of pressure roller or the position of cutting knife, has a different pitch and/or a different pitch direction in specific regions.

The required position of the pressure roller and/or the position of the cutting knife depends on the web width and on the configuration principle of the press. Folding formers are either designed using a maximum web width configuration principle or a minimum web width configuration principle. In the former, the position of the pressure roller and/or the position of the cutting knife are in each case led to the center of the stationary folding former by means of turner devices for web width that are narrower than the maximum width webs. In the latter, the position of the pressure roller and/or the position of the cutting knife are pushed away from one another for web widths that are larger than the minimum web width. The different configuration principles require different forms of the threaded spindle, illustrated in FIG. 4 and FIG. 6 and discussed in detail below. The form of the threaded spindle is thus dependent on the configuration principle of the printing installation.

To reduce the changeover time in using such an apparatus, the apparatus is designed with only one adjusting motor and with only one position monitoring device. All the pressure rollers and/or cutting knives of a pull group upstream of the folding former may be adjusted simultaneously or immediately one after another and their position may be monitored. In addition, this permits a format-independent design of this pull group.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
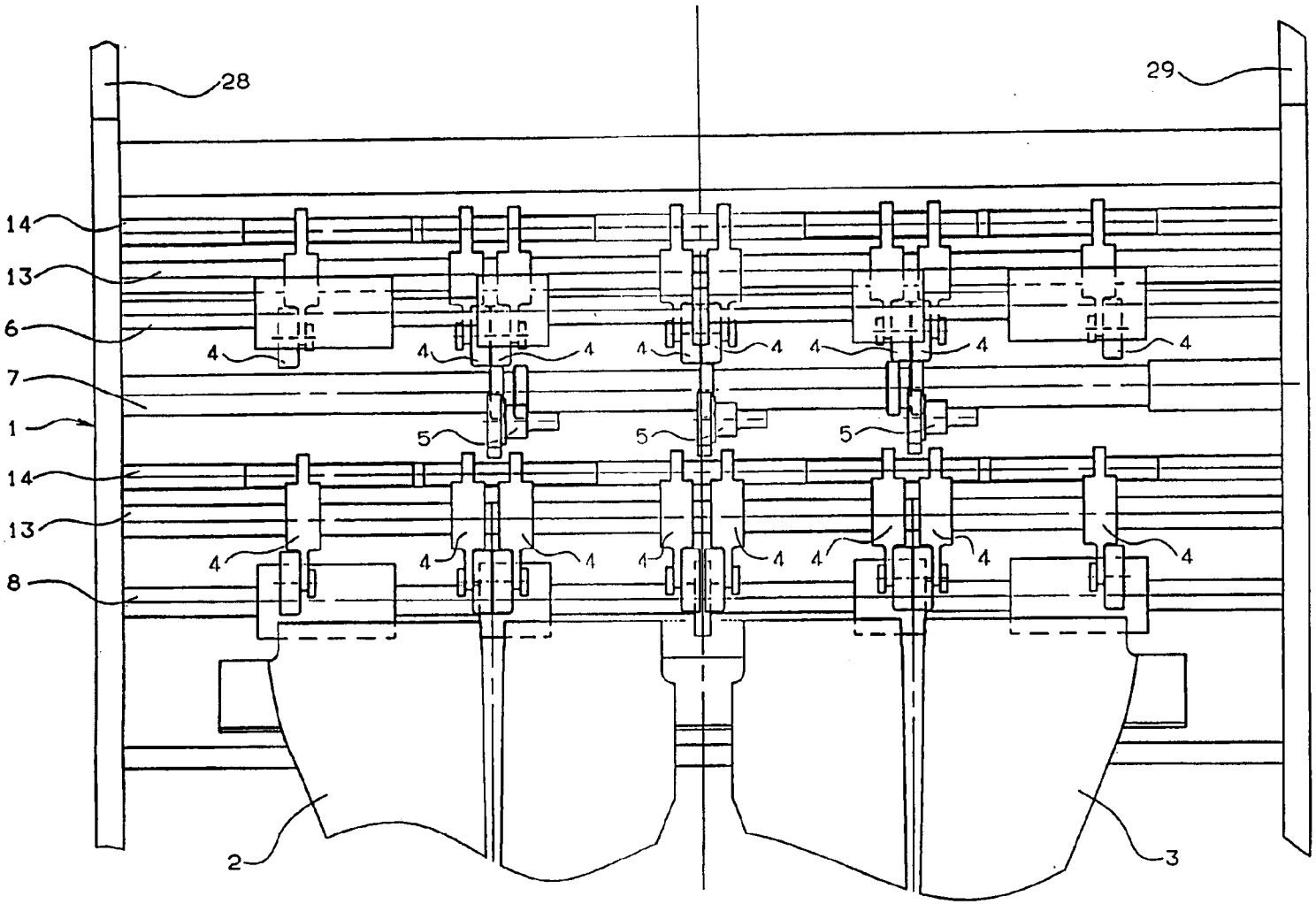
FIG. 1 is a front schematic view of an apparatus according to the present invention for adjusting pressure rollers and/or cutting knives upstream of a folding former.

FIG. 1 illustrates a folding assembly 1 having a double former including a first folding former 2 and a second folding former 3 located beside each other in one plane.

Figure 2:
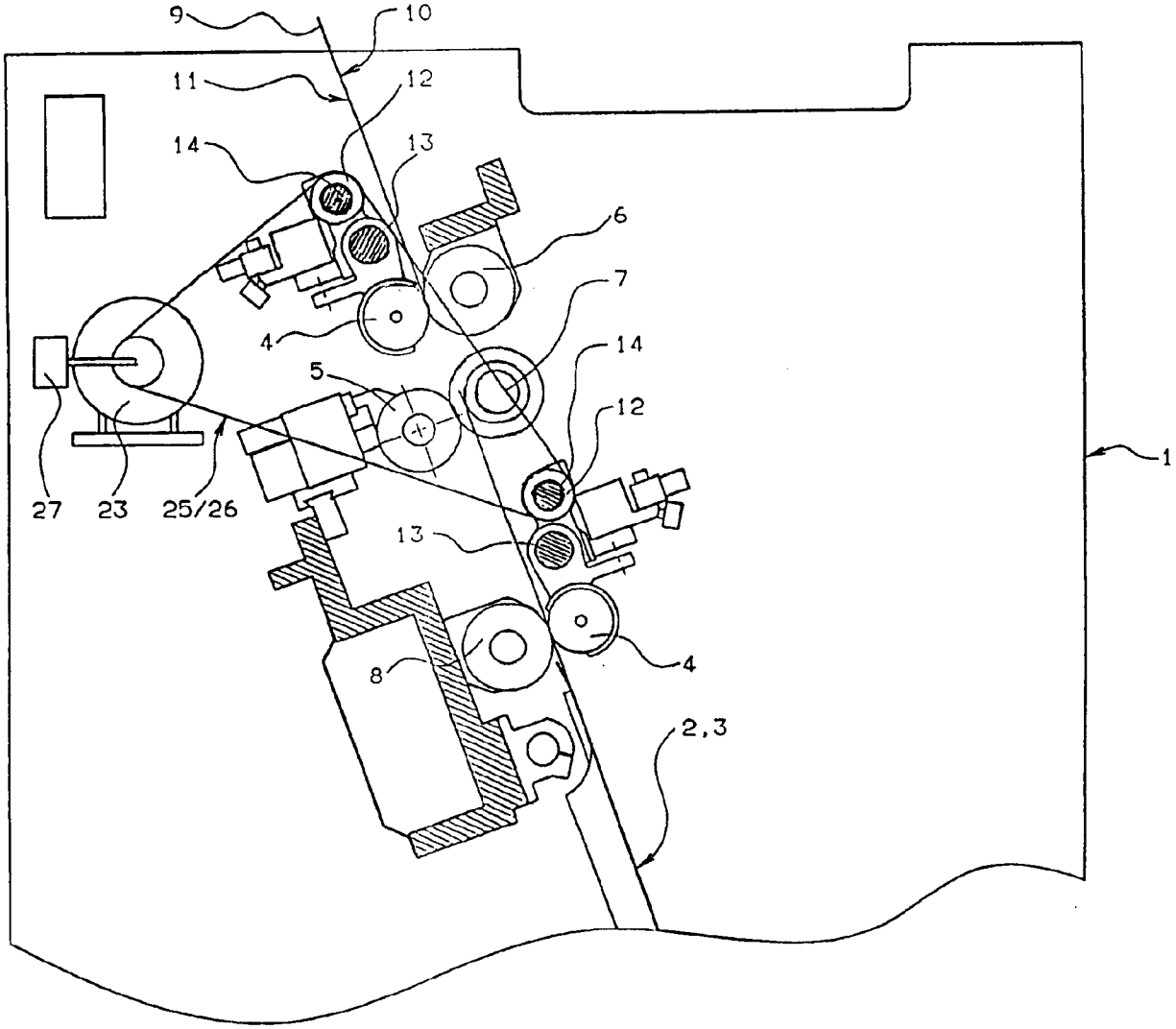
FIG. 2 is a side view of the apparatus according to FIG. 1.

Sixteen pressure rollers 4 and three cutting knives 5 are arranged above the two formers 2, 3 and mounted between side walls 28, 29 of the folding assembly 1. The pressure rollers 4 and cutting knives 5 are capable of being set on and off a printing material web 9 directly or by lever mechanisms not specifically illustrated. The pressure rollers 4 and cutting knives 5 are collectively referred to a web contacting elements. Referring also to FIG. 2, driven pull rods 6, 8 and a knife roll 7, which extend over the width of the web 9, are arranged opposite the pressure rollers 4 and the cutting knives 5. Alternatively, instead of the pull rods 6, 8, use can also be made of driven pull rollers positioned opposite the pressure rollers 4 and cutting knives 5. The printing material web 9 is led through the folding assembly 1 between the driven pull rods 6, 8 and pressure rollers 4 and between the knife roll 7 and the cutting knives 5. In the example of FIGS. 1 and 2, eight pressure rollers 4 are capable of being set against the front side 10 and another eight pressure rollers 4 are capable of being set against the rear side 11 of the printing material web 9.

Each of the pressure rollers 4, which can be set against the front side 10 and the rear side 11, are mounted such that they can be displaced axially on a guide element 13 by a threaded bush 12, for example configured in the manner of a lever. The axial position of the pressure rollers 4 is fixed by the threaded bush 12 through which a threaded spindle 14 is rotatably inserted. The axial position of the pressure rollers 4 is adjusted by rotating the threaded spindle 14. A threaded spindle 14 is provided for the pressure rollers 4 of the front side 10 and a further threaded spindle 14 is provided for the pressure rollers 4 of the rear side 11 of the printing material web 9, such that there are at least two threaded spindles 14. In addition, the cutting knives 5 may be arranged on the upper guide element 13 so that they are axially displaceable by the threaded bushes 12 and adjustable in their axial position by rotation of the threaded spindle 14 of the upper guide element 13.

Figure 2A:
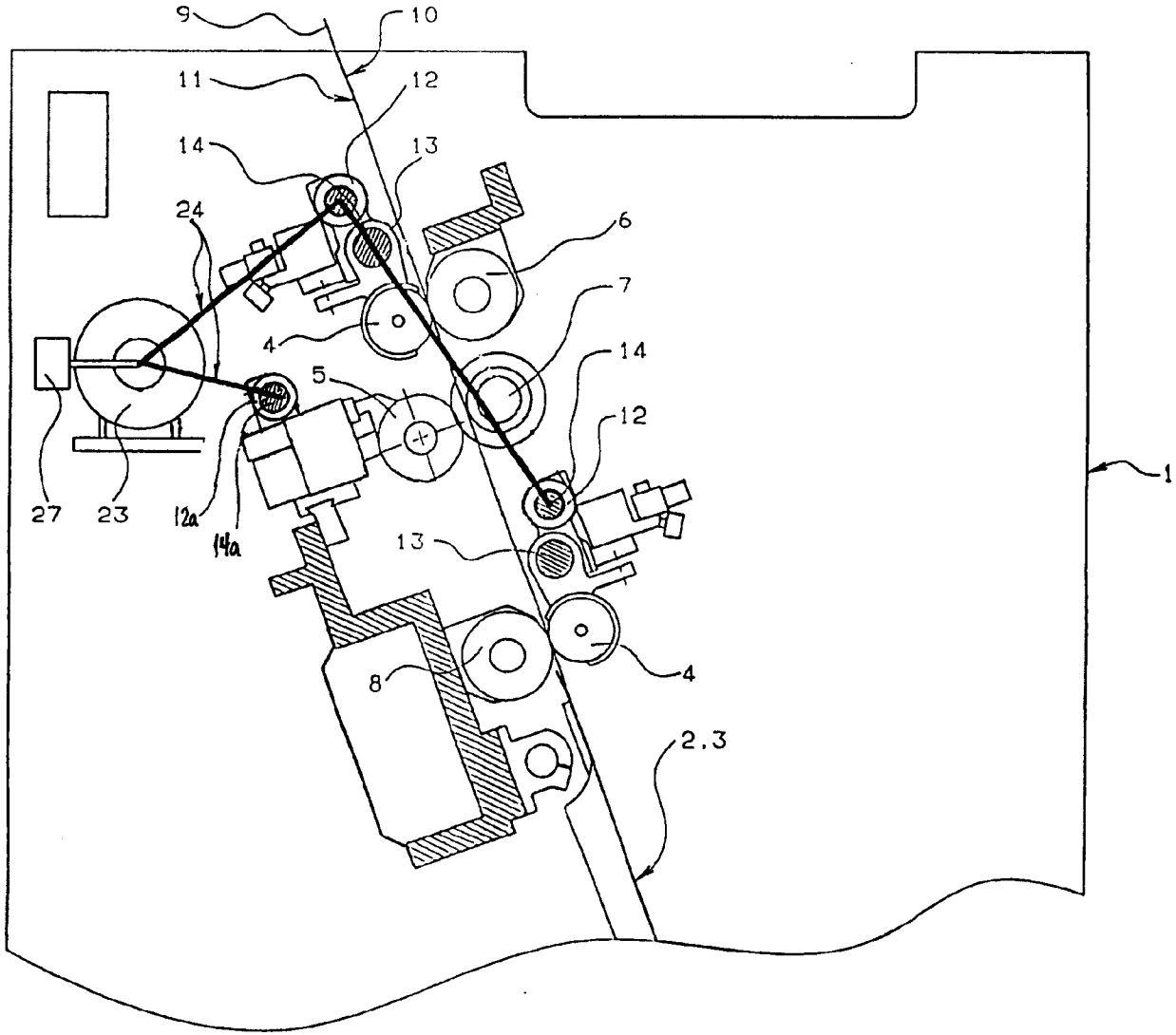
FIG. 2*a* is a side view of an apparatus according to another embodiment of the present invention.

In an alternative embodiment shown in FIG. 2*a*, the cutting knives 5 may also be arranged on their own threaded spindle 14*a*, so the apparatus for the axial adjustment of the pressure rollers and cutting knives comprises a total of three threaded spindles 14, 14*a*.

The pressure rollers 4 and cutting knives 5 mounted on the guide elements 13 may be movable from a set off position to a set on position. For example, the pressure rollers 4 and cutting knives may be set off the printing material web 9 to adjust their axial position and, following the adjustment of their axial position, may then be set on to the printing material web 9.

As shown in FIGS. 2 and 2*a* the threaded spindles 14 are preferably driven by a drive 23 by either a gear mechanism 24 (FIG. 2*a*), a belt drive 25 (FIG. 2) or a chain drive 26 (FIG. 2). A position monitoring device 27 such as, for example, a rotary encoder is arranged on the drive 23, which may comprise a motor. Alternatively, the position monitoring device 27 may also be arranged on the gear mechanism 24, the belt drive 25, or the chain drive 26.

The inventive configuration allows the adjustment of all the pressure rollers 4 and/or cutting knives 5 with only one drive 23 and allows and monitoring and/or a determination of the axial adjustment movement and/or axial position of all the pressure rollers 4 and/or cutting knives 5 using only one position monitoring device 27. As a further alternative, the drive 23 may be a stepping motor, which obviates the requirement for the position monitoring device 27.

The position of pressure rollers 4 and/or the position of the cutting knives 5 depends on the web width of the printing material web 9 and on the configuration principle of the press (described below).

Figure 4:
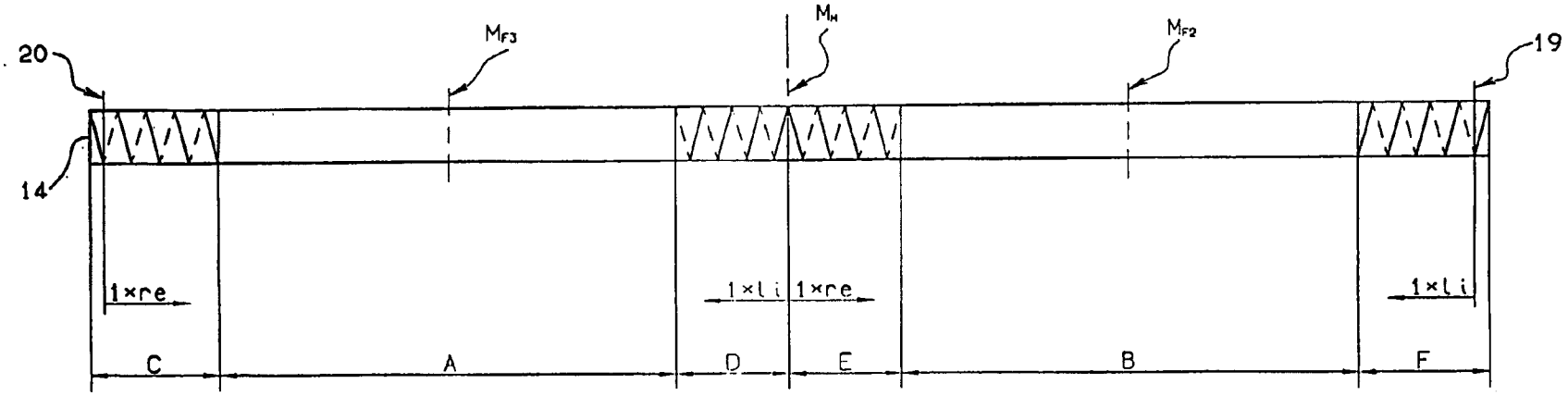
FIG. 4 is a side view of a threaded spindle for the embodiment of FIG. 3.

The threaded spindle 14 for adjusting the pressure rollers 4 and cutting knives 5 according to a first configuration principle has a different pitch and/or a different pitch direction in specific regions A, B, C, D, E, F, depending on the position of pressure roller 4 and the position of cutting knives 5 (see FIG. 4).

Figure 6:
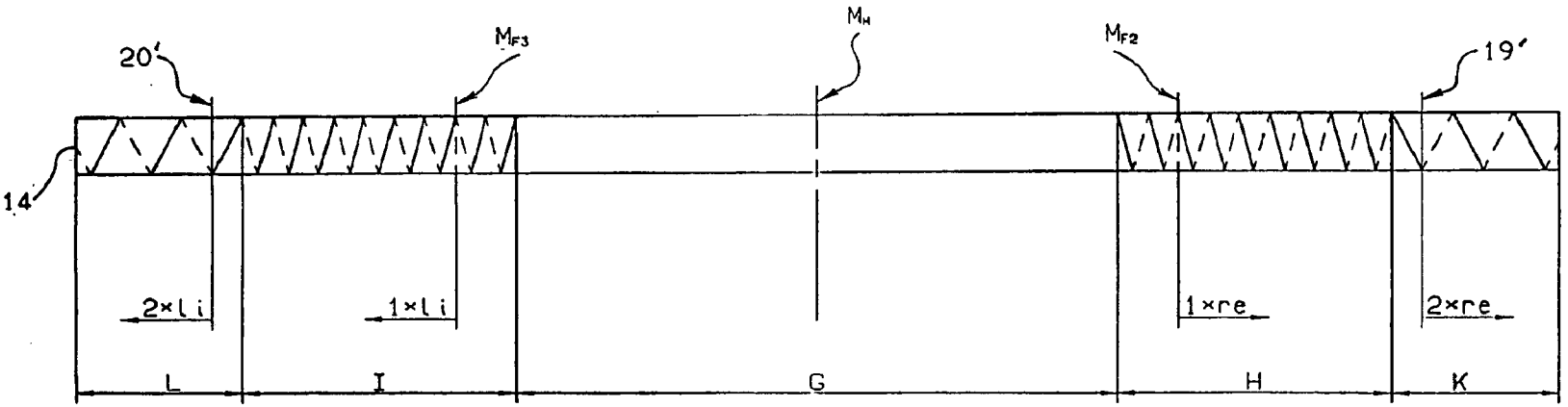
FIG. 6 is a side view of the threaded spindle for the embodiment of FIG. 5.

The threaded spindle 14 for adjusting the pressure rollers 4 and cutting knives 5 according to a second configuration principle has a different pitch and/or a different pitch direction in specific regions G, H, I, J, K, L, depending on the position of pressure roller 4 and the position of the cutting knives 5 (see FIG. 6).

Figure 3:
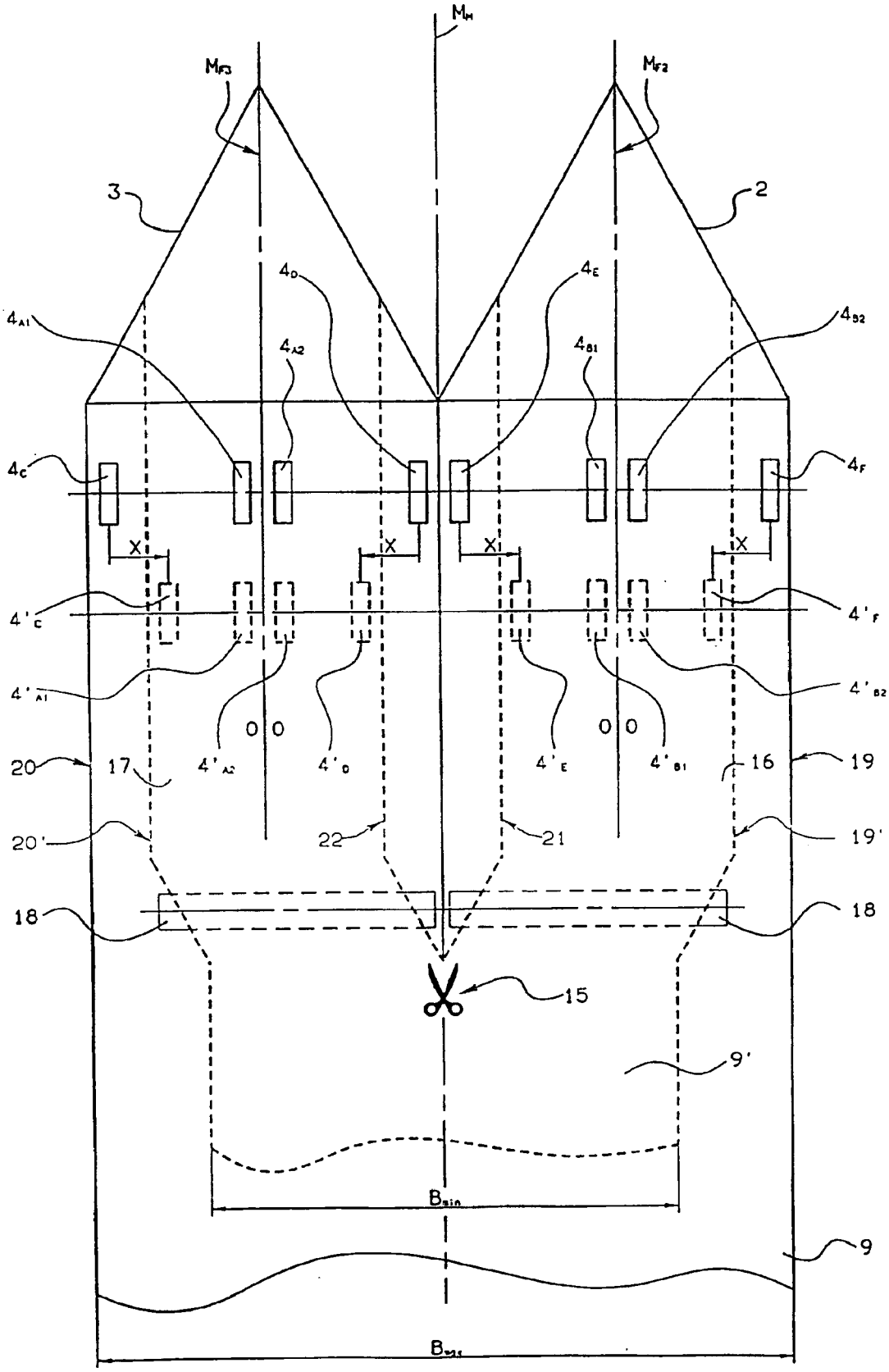
FIG. 3 is a schematic view of a pressure roller configuration in a folding former arrangement of a printing installation according to a first embodiment of the present invention.

The first configuration principle is shown schematically in FIG. 3. In the first configuration principle, the folding formers 2, 3 are designed for a printing material web 9 having a maximum web width $B_{max}$. If a narrower printing material web 9' is to be processed, the narrower printing material web 9' is cut into two part-webs 16, 17 upstream of the printing units, which are not specifically illustrated, by a cutting apparatus 15 and each of the two part-webs 16, 17 is led to the respective centers $M_{F2}$, $M_{F3}$ of the stationary folding formers 2, 3 by a spreading apparatus (not shown) and a turner device 18.

The positions of the pressure rollers $\mathbf{4}_A$ to $\mathbf{4}_F$ illustrated in FIG. 3 and the positions of the cutting knives, not illustrated for improved clarity, have to be set to the new format resulting from the narrower web width $B_{min}$ of the narrower printing material web 9'. That is, the pressure rollers $\mathbf{4}_A$ to $\mathbf{4}_F$ and cutting knives have to be set to new non-printing regions.

In the first configuration principle of FIGS. 3 and 4, the pressure rollers $\mathbf{4}_{A1}$, $\mathbf{4}_{A2}$, $\mathbf{4}_{B1}$, $\mathbf{4}_{B2}$ and the cutting knives, not illustrated for improved clarity, are arranged in the position proximate the center $M_{F2}$, $M_{F3}$ of the folding formers 2, 3, i.e., assigned to the region A, B of the threaded spindle 14 (see FIG. 4), and do not have their position changed when processing narrower printing material webs 9'. Accordingly, the threaded spindle 14 has no thread (pitch P=0) in the regions A,B. Thus, the respective positions $\mathbf{4'}_{A1}$, $\mathbf{4'}_{A2}$, $\mathbf{4'}_{B1}$, $\mathbf{4'}_{B2}$ of the pressure rollers remain unchanged with respect to respective positions $\mathbf{4}_{A1}$, $\mathbf{4}_{A2}$, $\mathbf{4}_{B1}$, $\mathbf{4}_{B2}$.

The pressure rollers $\mathbf{4}_C$, $\mathbf{4}_D$, $\mathbf{4}_E$, $\mathbf{4}_F$ are set against the respective web edges 19', 20', 21, 22 of the part-webs 16, 17 and each of these pressure rollers $\mathbf{4}_C$, $\mathbf{4}_D$, $\mathbf{4}_E$, $\mathbf{4}_F$ must always be moved by the same adjustment travel, but running in different directions. In the example shown in FIGS. 3 and 4 the pressure rollers $\mathbf{4}_C$, $\mathbf{4}_D$, $\mathbf{4}_E$, $\mathbf{4}_F$ are moved by an adjustment travel (i.e., a distance) equal to X. Accordingly, the threaded spindle 14 is equipped with a pitch P which is of the same height but different in terms of its direction in the regions C and D, and E and F (see FIG. 3 and FIG. 4).

In the practical exemplary embodiment, the threaded spindle 14 for adjusting the pressure roller $\mathbf{4}_C$ into its position $\mathbf{4'}_c$ at the web edge 20, 20' which is drawn over the folding former 3, that is to say in the region C, is configured with a right-hand thread with the pitch P=1 (see FIGS. 3 and 4).

The threaded spindle 14 for adjusting the pressure roller $\mathbf{4}_D$ into its position $\mathbf{4'}_D$ on the folding former 3 starting from the position at the centre of the machine $M_M$, that is to say in the region D, is configured with a left-hand thread with the pitch P=1 (see FIGS. 3 and 4).

The threaded spindle 14 for adjusting the pressure roller $\mathbf{4}_F$ into its position $\mathbf{4'}_F$ at the web edge 19, 19' which is drawn over the folding former 2, that is to say in the region F, is configured with a left-hand thread with the pitch P=1 (see FIGS. 3 and 4).

The threaded spindle 14 for adjusting the pressure roller $\mathbf{4}_E$ into its position $\mathbf{4'}_E$ on the folding former 2 starting from its position at the centre of the machine $M_M$, that is to say in the region E, is configured with a right-hand thread with the pitch P=1 (see FIGS. 3 and 4).

Figure 5:
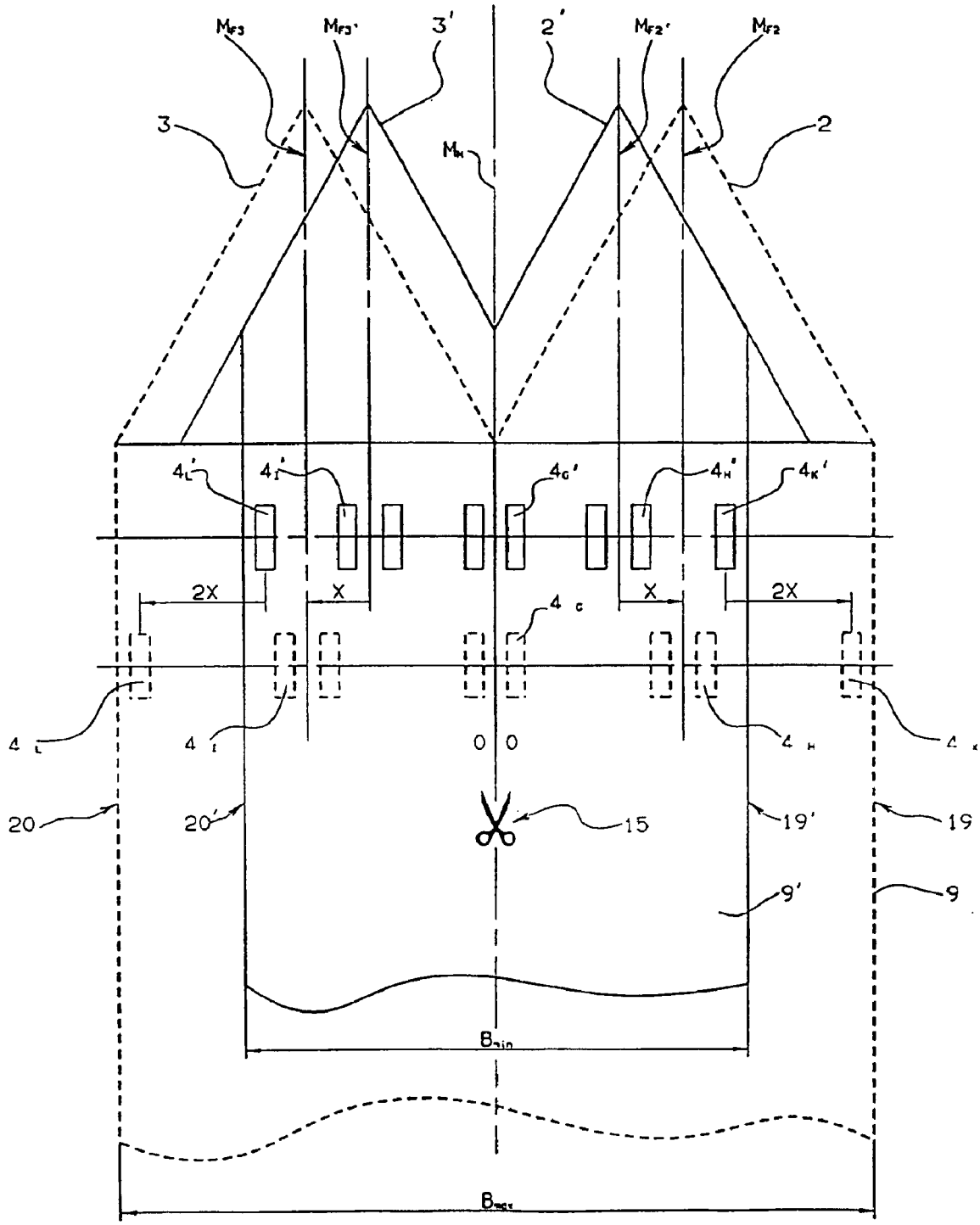
FIG. 5 is a schematic view of a pressure roller configuration in a folding former arrangement of a printing installation according to a further embodiment of the present invention.

The second configuration principle is shown schematically in FIG. 5. In the second configuration principle, the folding formers 2', 3' are designed for the narrower printing material web 9' with the minimum web width $B_{min}$ and are pushed apart to the positions 2, 3 in the event of a greater web width. The positions of the pressure rollers $\mathbf{4}_G$ to $\mathbf{4}_L$ and the positions of the cutting knives, not illustrated for improved clarity, must be set to the new format resulting from the wider printing material web 9, i.e. the pressure rollers $\mathbf{4}_G$, $\mathbf{4}_H$, $\mathbf{4}_I$, $\mathbf{4}_K$, $\mathbf{4}_L$ and the cutting knives must be set to new non-printing regions. In the second configuration principle, the pressure rollers $\mathbf{4}_G$ and the cutting knives which are arranged in the position of the center of the machine $M_M$, do not have their position changed, that is to say the threaded spindle 14 has no thread (P=0) in the region G (see FIG. 6). Thus, the position of the pressure rollers $\mathbf{4}_G$ remains unchanged with respect to the position $\mathbf{4'}_G$.

The pressure rollers $\mathbf{4'}_H$, $\mathbf{4'}_I$ and cutting knives which are arranged at the position of the centers $M_{F2}'$, $M_{F3}'$ of the folding formers 2', 3' are assigned to the regions H, I of the threaded spindle 14 and must be adjusted axially by an adjustment travel X. The pressure rollers $\mathbf{4}_K'$, $\mathbf{4}_L'$ which are set against the respective web edges 19', 20' of the narrower printing material web 9', always having to be adjusted axially by a second adjustment travel 2X (see FIGS. 5 and 6). The second adjustment travel 2X here corresponds to twice the adjustment travel X.

In the region K, L for the pressure rollers $\mathbf{4'}_K$, $\mathbf{4'}_L$ which are set against the respective web edges 19, 20, 19', 20', the threaded spindle 14 is configured with a pitch 2P which is twice as high as compared with the pitch P at the position of the centers $M_{F2}$, $M_{F3}$ of the folding formers 2, 3, that is to say in the region H and I, and extends in the same direction (see FIGS. 5 and 6).

In the practical exemplary embodiment, the threaded spindle 14 for adjusting the pressure roller $\mathbf{4}_L'$ into its position $\mathbf{4}_L$ at the web edge 20, 20' which is drawn over the folding former 3, that is to say in the region L, is configured with a left-hand thread with the pitch P=2 (see FIGS. 5 and 6).

The threaded spindle 14 for adjusting the pressure roller $\mathbf{4}_I'$ into its position $\mathbf{4}_I$ at the centre of the folding former $M_{F3}$, that is to say in the region I, is configured with a left-hand thread with the pitch P=1 (see FIGS. 5 and 6).

The threaded spindle 14 for adjusting the pressure roller $\mathbf{4'}_K$ into its position $\mathbf{4}_K$ at the web edge 19, 19' which is drawn over the folding former 2, that is to say in the region K, is equipped with a right-hand thread with the pitch P=2 (see FIGS. 5 and 6).

The threaded spindle 14 for adjusting the pressure roller $\mathbf{4'}_H$ into its position $\mathbf{4}_H$ at the centre of the folding former $M_{F2}$, that is to say in the region H, is configured with a right-hand thread with the pitch P=1 (see FIGS. 5 and 6).

Starting from the position at the centre of the machine $M_M$, the threaded roller 14 can be constructed in mirror-image fashion or symmetrically for the first configuration principle and also for the second configuration principle (see FIG. 4 and FIG. 6).

The apparatus is not intended just to be restricted to use in the case of pressure rollers 4 and cutting knives 5 and their arrangement on the double former. The apparatus may also be used, by way of non-limiting example, to continuously axially adjust perforating devices, trolleys or skip-slitters.

The apparatus may also be used for adjusting pressure rollers 4 and/or cutting knives 5 in folding assemblies, turning assemblies and web guide elements. In addition, each threaded spindle 14 may be configured with its own drive. The cutting knives 5 may also be adjusted axially continuously by their own common threaded spindle 14.

The apparatus may be configured such that, for each adjustment travel X or adjustment travel 2X or adjustment travel 3X, a separate threaded spindle 14 is provided that is driven by gear mechanisms with a defined transmission ratio with respect to rotational speed and direction of rotation.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for processing printing material webs with variable web widths, the apparatus being one of a folding assembly, a turning assembly, and a web guide and comprising:

web contacting elements including at least one of rollers and cutting knives, each of which is settable on one side of the printing material web;

driven pull rollers or driven pull rollers and knife rolls extending over the web width and arranged opposite said web contacting elements;

at least one threaded spindle operatively connected for adjusting axial positions of said web contacting elements simultaneously or in succession, wherein a first portion of said web contacting elements are adjusted by a first adjustment travel and a second portion of said web contacting elements are adjusted by a second adjustment travel different than said first adjustment travel, wherein said at least one threaded spindle is divided into regions, wherein each of said regions is assigned to individual ones of said web contacting elements and said regions are configured with pitches (P) of different pitch height and pitch direction, the pitch height and pitch direction being configured in accordance with the adjustment travel of said individual web contacting elements.

2. The apparatus of claim 1, wherein said first adjustment travel is zero such that said first portion of said web contacting elements are stationary.

3. The apparatus of claim 2, wherein a third portion of said web contacting elements are adjusted by a third adjustment travel that is greater than zero and different from said second adjustment travel.

4. The apparatus of claim 1, wherein each of said first adjustment travel and said second adjustment travel is non zero.

5. The apparatus of claim 1, wherein the apparatus is a folding assembly and the web contacting elements are in a folding former plane of the folding assembly.

6. The apparatus of claim 1, wherein said web contacting elements comprise pressure rollers and cutting knives and said at least one threaded spindle comprises at least two threaded spindles, said pressure rollers being axially adjustable by at least one of said at least two threaded spindles and said cutting knives being axially adjustable by a further one of said at least two threaded spindles.

7. The apparatus of claim 1, wherein said at least one threaded spindle symmetric about a center line of said apparatus.

8. The apparatus of claim 1, further comprising a single drive for driving said at least one threaded spindle.

9. The apparatus of claim 1, further comprising at least one position monitoring device for determining the axial position of all web contacting elements.

10. An apparatus for processing printing material webs with variable web widths, the apparatus being one of a folding assembly, a turning assembly, and a web guide and comprising:

web contacting elements including at least one of rollers and cutting knives, each of which is settable on one side of the printing material web;

driven pull rollers or driven pull rollers and knife rolls extending over the web width and arranged opposite said web contacting elements;

at least one threaded spindle operatively connected for adjusting axial positions of said web contacting elements simultaneously or in succession, wherein a first portion of said web contacting elements are adjusted by a first adjustment travel and a second portion of said web contacting elements are adjusted by a second adjustment travel different than said first adjustment travel, wherein a separate threaded spindle is provided for each of the first and second adjustment travels, said apparatus further comprising a drive with gear mechanisms with a defined transmission ratio with respect to rotational speed and direction of rotation for driving said threaded spindles.

11. The apparatus of claim 10, wherein said at least one threaded spindle is symmetric about a center line of said apparatus.

12. The apparatus of claim 11, wherein said drive is a stepping motor.

13. The apparatus of claim 10, wherein said first adjustment travel is zero such that said first portion of said web contacting elements are stationary.

14. The apparatus of claim 13, wherein a third portion of said web contacting elements are adjusted by a third adjustment travel that is greater than zero and different from said second adjustment travel.

15. The apparatus of claim 10, wherein each of said first adjustment travel and said second adjustment travel is non zero.

16. The apparatus of claim 10, wherein the apparatus is a folding assembly and the web contacting elements are in a folding former plane of the folding assembly.

17. The apparatus of claim 10, further comprising a single drive for driving said at least one threaded spindle.

18. The apparatus of claim 10, further comprising at least one position monitoring device for determining the axial position of all web contacting elements.

* * * * *